US007845827B2

(12) United States Patent
Tarter et al.

(10) Patent No.: US 7,845,827 B2
(45) Date of Patent: Dec. 7, 2010

(54) LED SPOTLIGHT

(75) Inventors: Kevin J. Tarter, Wichita, KS (US); Alton Yat-Hung Leung, Hong Kong (CN)

(73) Assignee: The Coleman Company, Inc., Wichita, KS (US)

( * ) Notice: Subject to any disclaimer, the term of this patent is extended or adjusted under 35 U.S.C. 154(b) by 220 days.

(21) Appl. No.: 12/115,090

(22) Filed: May 5, 2008

(65) Prior Publication Data

US 2008/0278946 A1 Nov. 13, 2008

Related U.S. Application Data

(60) Provisional application No. 60/916,714, filed on May 8, 2007.

(51) Int. Cl.
*F21V 7/00* (2006.01)

(52) U.S. Cl. ..... 362/247; 362/240; 362/249.02

(58) Field of Classification Search ..... 362/240, 362/247, 800, 249.02
See application file for complete search history.

(56) References Cited

U.S. PATENT DOCUMENTS 4,654,629 A 3/1987 Bezos et al.
6,367,949 B1 * 4/2002 Pederson ..... 362/240
7,214,952 B2 * 5/2007 Klipstein et al. ..... 250/504 H
7,578,599 B2 * 8/2009 Moser et al. ..... 362/187
2002/0196620 A1 12/2002 Sommers et al.
2003/0035286 A1 2/2003 Parker et al.
2005/0007777 A1 1/2005 Klipstein et al.
2005/0174772 A1 8/2005 Gun
2005/0231974 A1 10/2005 Ruffin
2006/0245180 A1 11/2006 Hsu
2008/0198615 A1 * 8/2008 Klipstein ..... 362/538

FOREIGN PATENT DOCUMENTS

DE 20317017 2/2004

* cited by examiner

*Primary Examiner*—Stephen F Husar
*Assistant Examiner*—James W Cranson
(74) *Attorney, Agent, or Firm*—Kelly S. Elsea

(57) ABSTRACT

A spotlight (20) that utilizes a plurality of light emitting diodes (LEDs) (44, 46). The spotlight (20) converges light beams ($B_1$, $B_2$) from the LEDs (44, 46) to a concentrated beam of light (300) of a defined width. Each LED (44, 46) has its own parabolic reflector (34, 36, 38). The parabolic reflectors (34, 36, 38) are focused so that bright, collimated light beams ($B_1$, $B_2$) from the parabolic reflectors (34, 36, 38) are converged and collocated at a defined distance to give the appearance of a single, narrow intense beam of light (300).

5 Claims, 5 Drawing Sheets

LED SPOTLIGHT

REFERENCE TO RELATED APPLICATION

This application claims priority to U.S. provisional patent application Ser. No. 60/916,714, filed May 8, 2007, and incorporated herein by reference.

BACKGROUND OF THE INVENTION

A spotlight is a light designed to direct a narrow intense beam of light on a small area. Often, spotlights utilize halogen lamps because of their bright intensity. A downside to the use of halogen lamps is that they require a lot of amperage for operation. Thus, a halogen spotlight that utilizes batteries may require frequent recharging or replacement of the batteries.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description of some embodiments that are presented later.

In accordance with an embodiment, a spotlight is provided that utilizes a plurality of light emitting diodes (LEDs). The spotlight converges the light beams from the LEDs to a concentrated beam of light of a defined width. The LEDs may be, for example, high intensity white LEDs.

In accordance with an embodiment, the spotlight includes at least two LEDs, each LED having its own parabolic reflector. The parabolic reflectors are focused so that bright, collimated light beams from the parabolic reflectors are converged and collocated at a defined distance to give the appearance of a single, narrow intense beam of light. As an example, the light beams from the parabolic reflectors may be converged so a diameter of the beam may be, for example, 75 centimeters at a three meter distance from the spotlight. The light beams may be converged by having the beams side by side and touching at the defined distance, the light beams may overlap, or the light beams may be very close to one another.

In accordance with an embodiment, the light beams from the multiple parabolic reflectors may be aligned in a number of different ways so that the light beams may properly converge. In one embodiment, each LED is provided on a separate circuit board and a corresponding parabolic reflector for the LED is directed to the appropriate location, and the LED is mounted perpendicular to the parabolic reflector. The parabola of the parabolic reflector is configured to collimate light from the LED and direct it in a direction so that it may converge with the light beams from other parabolic reflectors for the LED spotlight.

In another embodiment, multiple LEDs are provided on a common, flat circuit board. Each LED includes an angled spacer so as to direct a light from the LED in a desired direction. A parabolic reflector for each LED is mounted perpendicular to the LED, and directs collimated light from the LED in the desired direction.

In another embodiment, multiple LEDs are mounted on a common flat circuit board with the LEDs mounted flat to the circuit board. Each parabolic reflector, instead of being perpendicular to its respective LED, is aligned to collimate light from the LED and direct it in the desired direction, which in an embodiment is slightly angled from perpendicular with the LED. Optics of each of the parabolic reflectors are modified to collimate the light from the LED and direct the collimated light beam in the desired direction.

In still another alternative, the LEDs and associated parabolic reflectors may be arranged so that collimated light beams from the parabolic reflectors are collimated with each other. Thus, the distance between center portions of the light beam remain constant as the light beams move away from the LED spotlight. The diameter may increase slightly due to natural light dissemination as the distance increases from the spotlight, but the light beam for each parabola is not focused inward so as to converge the multiple light beams. In this embodiment, parabolic reflectors are spaced apart from one another so that proper collocation of the light beams occurs at the desired distance through the natural dissemination of the bright spots of the light beams.

In still another embodiment, lens optics may be used to converge multiple light beams.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described. In addition, to the extent that orientations of the embodiments are described, such as "top," "bottom," "front,"

"rear," "right," and the like, the orientations are to aid the reader in understanding the embodiment being described, and are not meant to be limiting.

Figure 1:
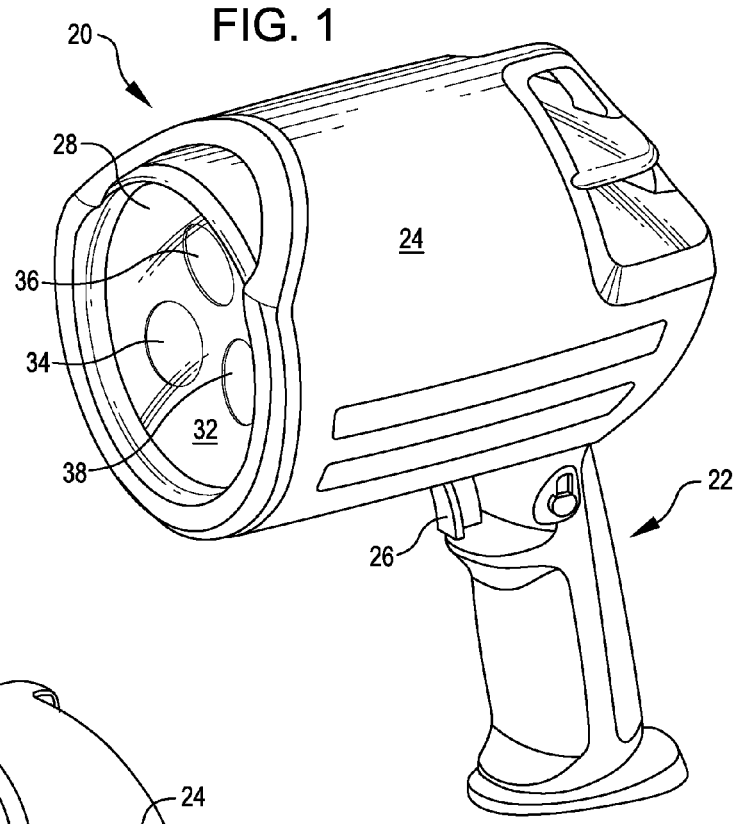
FIG. 1 is a side perspective view of a LED spotlight in accordance with an embodiment.

Referring now to the drawings, in which like reference numerals represent like parts throughout the several views, FIG. 1 shows an LED spotlight 20 in accordance with an embodiment. The LED spotlight 20 includes a handle 22 attached to a housing 24 for the LED spotlight. The housing 24 shown in the drawings is shaped as a cylinder, with a light coming out of one end of the cylinder. The handle 22 extends perpendicularly downward from the housing 24 so that it may be grasped such as a pistol. This arrangement permits a user to grasp the handle into the palm of a hand with the forearm extending parallel to a central axis of a light beam emanating from the housing. A trigger 26 is provided on the handle to turn on the LED spotlight. In addition, if desired, a lock feature may be provided for locking the trigger and LED spotlight 20 in an "on" position.

Figure 2:
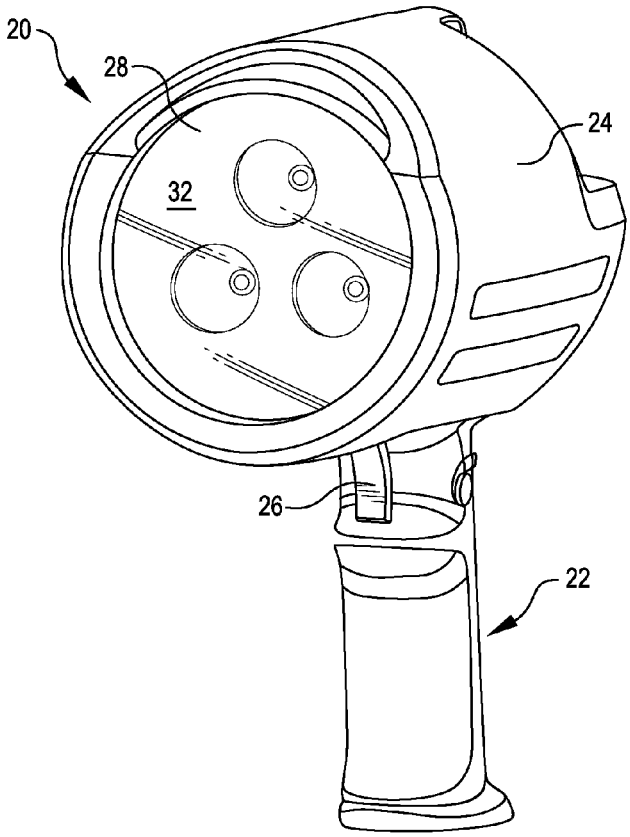
FIG. 2 is a front perspective view of the LED spotlight of FIG. 1.
Figure 3:
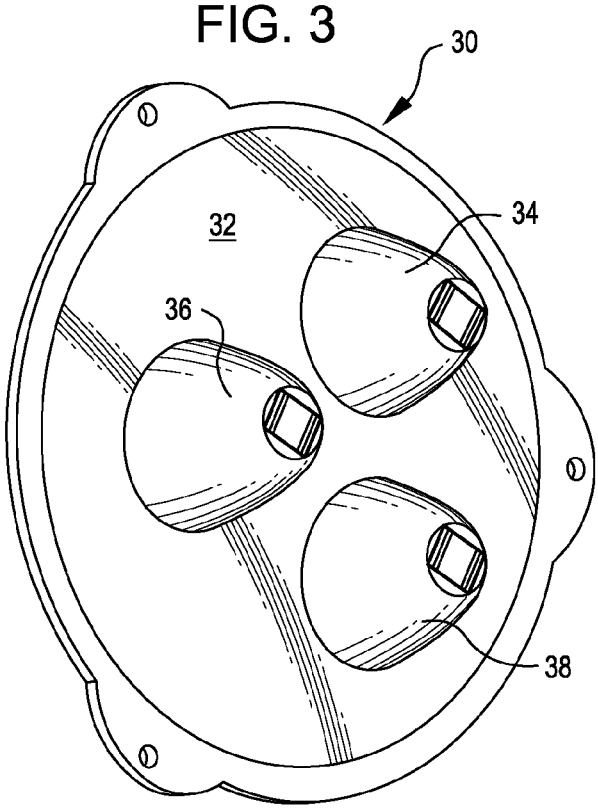
FIG. 3 is a rear perspective view of a reflector for use in the spotlight of FIG. 1 in accordance with an embodiment.
Figure 4:
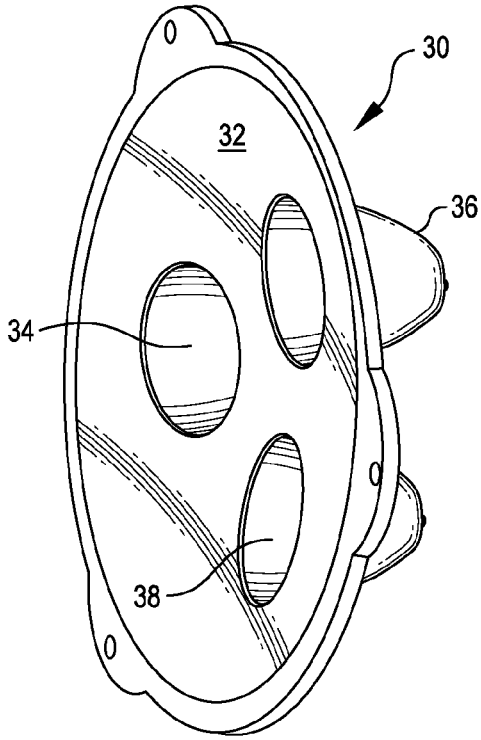
FIG. 4 is a front, side, perspective view of the reflector of FIG. 3.

The LED spotlight 20 includes a lens 28 mounted on the outside of a reflector 30. As can be seen in FIG. 2, the reflector 30 has a concave face 32 and a series of parabolic reflectors 34, 36 and 38 equally spaced around the face. The number of parabolic reflectors in the embodiment shown in the drawings is three. However, two parabolic reflectors or more than two parabolic reflectors may be utilized. However, three or more are preferably used so that a combined converged pattern will have more intense light output. In the embodiment shown in the drawings, the reflectors 34, 36, 38 are positioned to provide three light beams defining corners of an equilateral triangle.

The parabolic reflectors 34, 36 and 38 are utilized in a manner known in the art to collimate light from light emitting diodes (LEDs). If desired, collimators other than parabolic reflectors may be used to collimate light from the LEDs. For example, a collimator-style lens may be positioned over an LED. A collimator lens (without a parabolic reflector) mounted just above the LED collimates light from an LED to a very tight hot spot. Multiple collimator lenses may be angled to converge light from multiple LEDs.

In accordance with an embodiment, the housing 24 is formed of a suitable plastic material, such as acrylonitrile butadiene styrene (ABS). The lens 28 may also be formed of a plastic, such as a clear polycarbonate material. The lens 28 and the housing 24 are preferably sealed in a water tight manner. A battery, such as a rechargeable battery, may be utilized for powering of the LED spotlight 20. In an embodiment, the battery is a 12 volt sealed lead acid rechargeable battery. However, other batteries may be used.

LEDs (multiple embodiments are described below) are mounted at the base of the parabolic reflectors 34, 36, and 38. Each of the parabolic reflectors 34, 36, and 38 is configured and arranged so as collimate light from an LED so as to produce a focused, bright intensity light beam in which the majority of light from the beam is focused on a bright center. Preferably, the collimated light beams may be illuminated a great distance without significant light dispersion of the bright center. In accordance with an embodiment, the bright centers of light beams from the multiple parabolic reflectors 34, 36 and 38 are converged to a single bright spot. To determine proper convergence, this bright spot may be defined, for example, by a diameter of the converged light beams at a particular distance from the front of the LED spotlight 20. For example, in an embodiment, a LED spotlight, such as the LED spotlight 20, produces a converged light beam of approximately 75 centimeters in diameter at a three meter distance from the front of the LED spotlight 20. Other converged sizes may be utilized, but in general, the light beams from the LEDs are maintained in a tight pattern as far as possible so that the beam maintains a limited cross section even at a remote distance from the spotlight 20.

Figure 5:
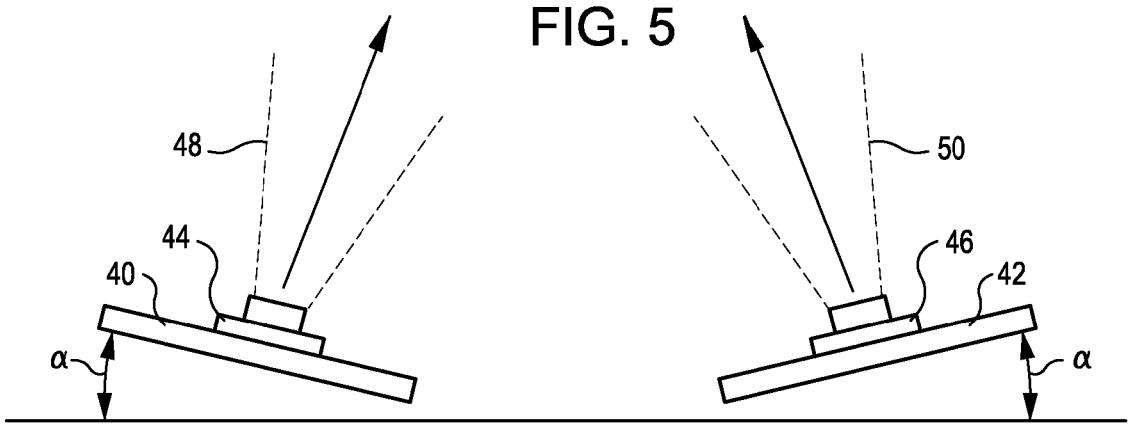
FIG. 5 is a representation of a LED and parabolic reflector combination that may be used in accordance with an embodiment.

As is known, LEDs typically have a 90 to 120 degree cone of light output emanating directly out of the front of the LED. In an embodiment, each parabolic reflector 34, 36 and 38 collimates the light from its LED into a bright center beam light beam with most light extending parallel to a central axis for the reflector, and at the same time aims that light beam at a desired location so the light beams from the combined reflectors are converged. Typically, for collimation, an LED is mounted perpendicular to a central axis of a parabolic reflector. For example, FIG. 5 shows one arrangement for providing converged light beams in which LEDs 44, 46 are mounted perpendicular to the central axes of parabolic reflectors 48, 50. In the embodiment shown in FIG. 5, two separate printed circuit boards 40, 42 each include a single LED 44, 46, respectively. The LEDs 44, 46 and the printed circuit boards 40, 42 are mounted at an angle $\alpha$ (to perpendicular with the longitudinal axis of the housing 24. The light beam of the spotlight 20 extends parallel to this longitudinal axis. The angle $\alpha$ (is set with respect to a radial axis emanating from the center of the LED spotlight 20, so that the tilted angle causes the light beam from the associated LED 44, 46 to focus inward towards a longitudinal axis of the housing 24 to converge light at the desired distance.

In the embodiment shown in FIG. 5, parabolic reflectors 48, 50 are mounted perpendicular to the LEDs 44, 46, respectively. These parabolic reflectors direct light to a converged position. As can be understood, the angle $\alpha$ (is exaggerated in the drawings so that concepts described herein are made clearer to a reader, but in actuality the angle $\alpha$ (may be very small.

Figure 8:
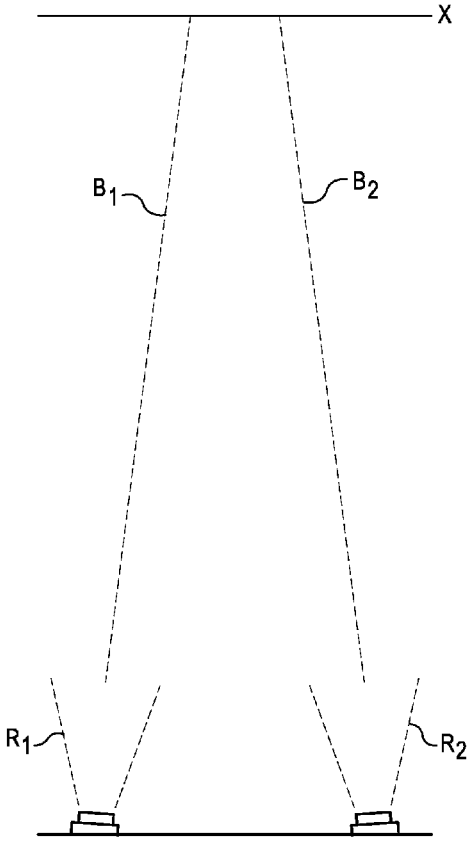
FIG. 8 is a representation of convergence of light by multiple LEDs and parabolic reflectors in accordance with an embodiment.

A plurality of LEDs and parabolic reflectors may be arranged as shown in FIG. 5 to provide a desired collimation of light beams from the LEDs. In an embodiment, three such light beams are converged in a triangular pattern 300 as shown in FIG. 8. The three beams may extend very close to each other so as to give an illusion of a single beam, may overlap each other completely or in part, or may be slightly spaced from each other. Applicants have found that defining a position 3 meters away in which the light beams are adjacent to each other so that they touch, but not overlap each other, provides a desired effect.

Figure 6:
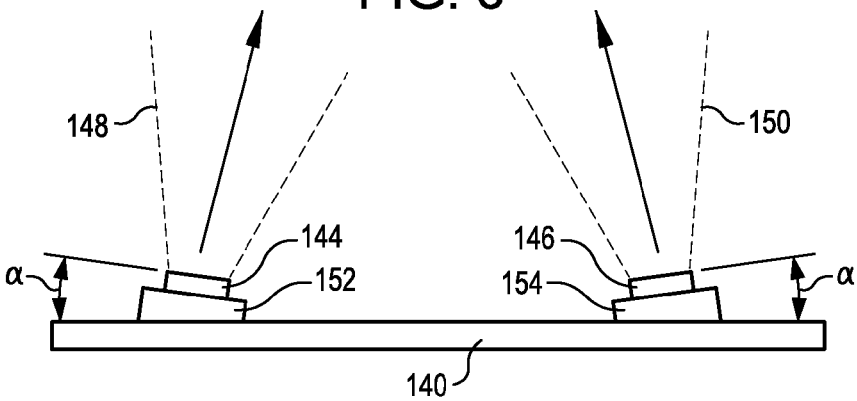
FIG. 6 is a representation of a LED and parabolic reflector combination that may be used in accordance with another embodiment.

FIG. 6 shows an alternate embodiment of a method of and structure for providing convergence of multiple light beams from multiple LEDs. In the embodiment shown in FIG. 6, a single printed circuit board 140 is utilized with two LEDs 144, 146. Each of these LEDs 144, 146 is mounted with an angled spacer 152, 154. These angled spacers cause the LEDs 144, 146 to be set at the angle $\alpha$ relative to perpendicular to the longitudinal axis of the housing 24. The corresponding parabolic reflectors 148, 150 are arranged perpendicular to the LEDs and thus direct light beams from the LEDs in the appropriate direction; i.e., generally parallel to a projection of the longitudinal axis of the housing.

Figure 7:
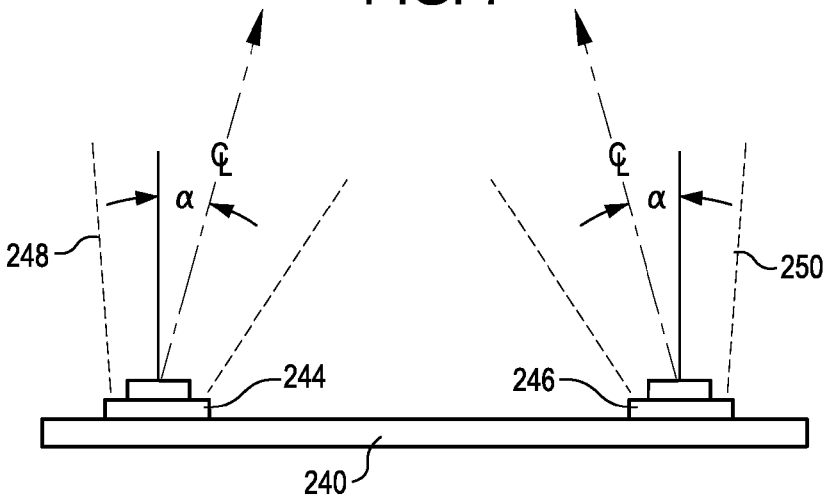
FIG. 7 is a representation of a LED and parabolic reflector combination that may be used in accordance with yet another embodiment.

In an alternate embodiment shown in FIG. 7, two LEDs 244, 246 are arranged on a single circuit board 240. The two LEDs are arranged so that they direct light straight outward. The parabolic reflectors 248, 250 for these two LEDs 244, 246 are tilted at the angle $\alpha$ from perpendicular to the LEDs 244, 246. In this manner, light from the LEDs 244, 246 is directed in an appropriate manner so that the light beams are converged as described above. Because the parabolic reflectors are not mounted perpendicular to the LEDs 244, 246, the optics of the parabolic reflectors may be altered to ensure the light beams from the LEDs are properly collimated and aimed. Such parabolic reflectors may be designed using computer modeling techniques known in the art.

Figure 9:
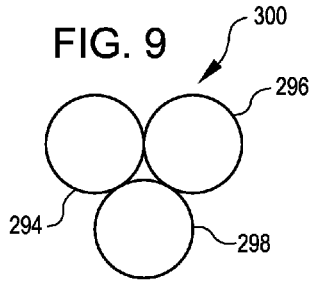
FIG. 9 is a representation of a light pattern generated by a spotlight, such as the spotlight of FIG. 1, in accordance with an embodiment.

As can be seen in FIG. 8, a representation of light beams $B_1$ and $B_2$ is shown coming from two reflectors $R_1$ and $R_2$. These light beams are converged a suitable distance from one another at a distance X from the front of the spotlight 20. An example light pattern 300 of the bright spots of three such beams 294, 296, and 298 is shown in FIG. 9. As can be seen, these light beams 294, 296, and 298 slightly touch one another at the location X. The light beams shown may represent the bright, central light beams provided by three conical reflectors, two of which may be the conical reflectors $R_1$ and $R_2$. Such convergence of light beams may be provided by any of the three embodiments shown in FIGS. 5-7.

Figure 10:
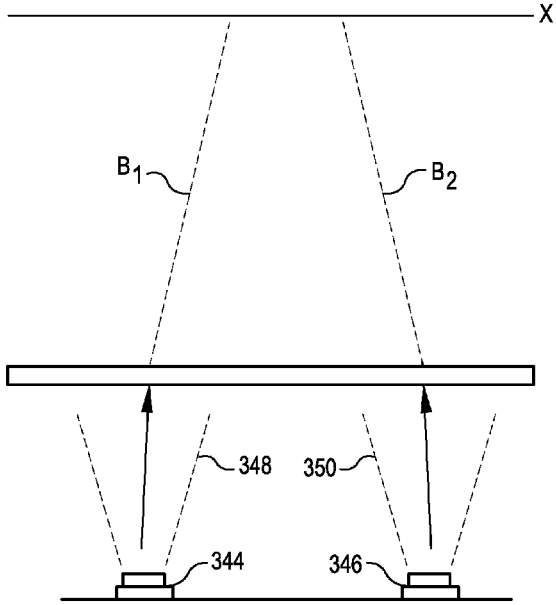
FIG. 10 is a representation of yet another embodiment of a LED and parabolic reflector combination.

In accordance with another embodiment, as shown in FIG. 10, one or more LEDs 344, 346 may be mounted under parabolic reflectors 348, 350 that direct beams straight outward. These reflectors may direct light to a lens 328 that includes optic features that bend light beams from the reflectors 348, 350 so that they converge an appropriate distance apart at a distance X from the front of the spotlight to provide a desired light pattern as described above.

In yet another embodiment, three LEDs may be mounted on three parabolic reflectors so that the parabolic reflectors direct three light beams straight outward and parallel to one another. In this embodiment, the reflectors are spaced from one another a distance so that at the distance X from the front of the spotlight 20 (e.g., three meters), each of the collimated central bright beams from the reflectors have become wide enough (i.e., have large enough diameters), through normal dispersion of collimated light, so that the bright centers touch, creating a central, focused light beam, such as the combined light beam 300, at the distance X. In this embodiment, the LEDs and the parabolic reflectors do not need to be aimed toward a central location for convergence to provide the spotlight effect.

Figure 11:
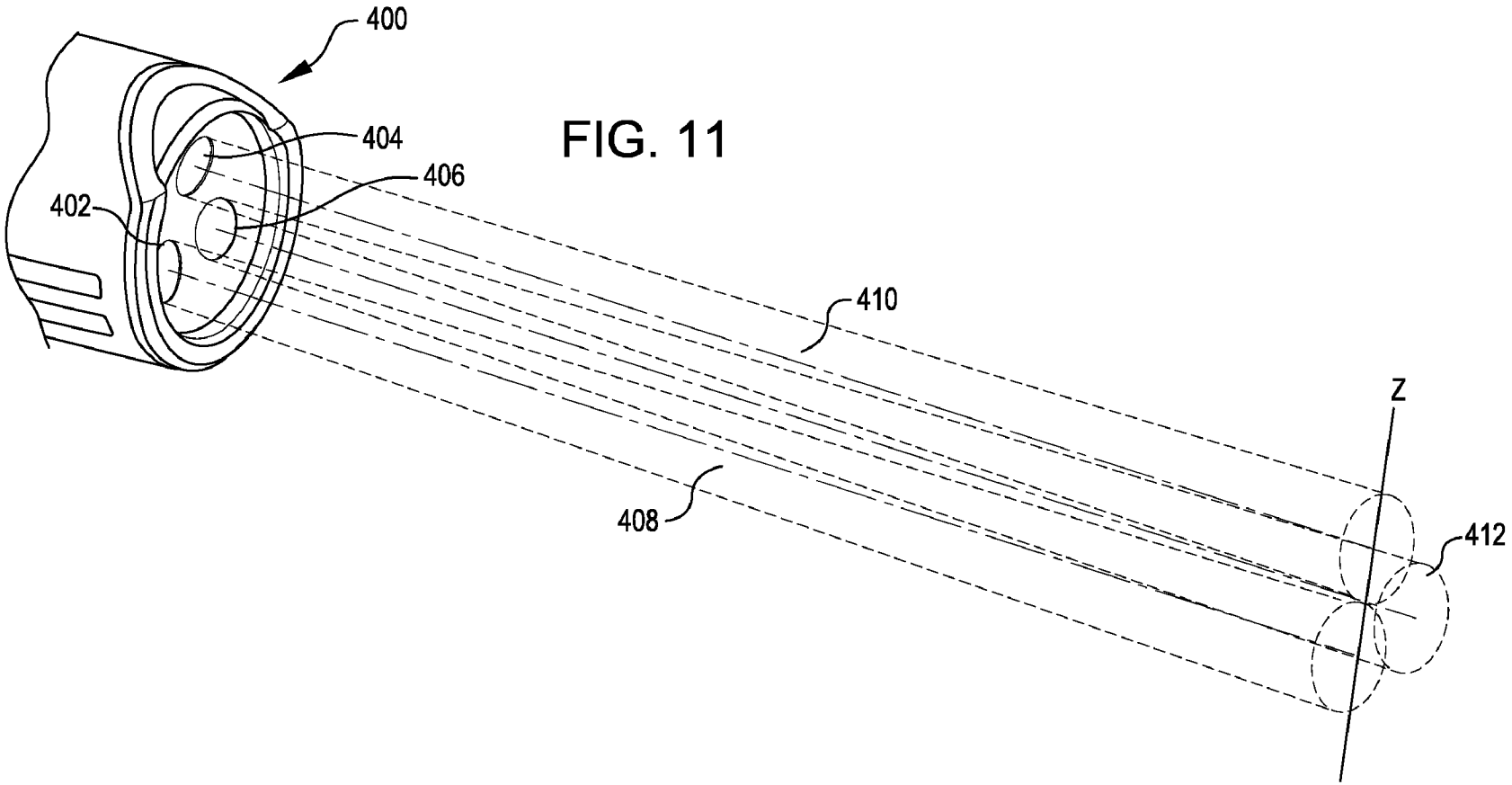
FIG. 11 is a representation of a spotlight and the spotlight's beam pattern in accordance with an embodiment.

For example, as shown in FIG. 11, a spotlight 400 includes three reflectors 402, 404, and 406. Each of these reflectors includes a light beam 408, 410, and 412, respectively. The light beams 408, 410, 412 are generally the width of the reflectors 402, 404, 406 when leaving the spotlight 400. However, during normal dispersion over a particular length, or by patterning the parabolic reflectors accordingly, the light beams increase in width until they touch at a distance Z from the spotlight 400. This distance may be any desired distance, but in an embodiment is three meters from the spotlight.

The LED spotlight 20 of the present invention provides a very bright spotlight, for example, providing light output similar to one million candle power halogen spotlight. By utilizing high powered bright white LEDs and a 12 volt rechargeable battery, a bright beam may be provided for several hours via the LED spotlight 20, in comparison to a very short time period for existing halogen spotlights. In addition, less heat is generated by the LEDs, thus providing a much safer spotlight.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A light, comprising:

a housing;

a handle connected to the housing and configured and arranged for at least one of transporting or aiming the light:

a plurality of LEDs mounted to the housing; and for each LED, a collimator for collimating light emanating from the LED so that there are a plurality of collimators on the light, wherein each of the collimators comprises a reflector;

the plurality of LEDs and the plurality of collimators being arranged so as to provide a concentrated beam of light directed along an axis, such that the combined light beams are converged to a defined diameter at a defined distance from the housing;

wherein the handle extends downward from the housing so that a user may grasp the handle into the palm of a hand with the forearm extending parallel to the axis;

wherein the light beams are converged so that the light beams are side by side and touching or overlap at the defined distance.

2. A light, comprising:

a housing;

a handle connected to the housing and configured and arranged for at least one of transporting or aiming the light:

a plurality of LEDs mounted to the housing; and for each LED, a collimator for collimating light emanating from he LED so that there are a plurality of collimators on the light, wherein each of the collimators comprises a reflector;

the plurality of LEDs and the plurality of collimators being arranged so as to provide a concentrated beam of light directed along an axis. such that the combined light beams are converged to a defined diameter at a defined distance from the housing;

wherein the handle extends downward from the housing so that a user may grasp the handle into the palm of a hand with the forearm extending parallel to the axis;

wherein each LED is provided on a separate circuit board and a corresponding collimator for the LED is directed for convergence in a direction mostly parallel with the axis, but slightly directed toward the axis.

3. A light, comprising:

a housing;

a handle connected to the housing and configured and arranged for at least one of transporting or aiming the light;

a plurality of LEDs mounted to the housing and provided on a common circuit board; and for each LED, a collimator for collimating light emanating from the LED so that there are a plurality of collimators on the light, wherein each of the collimators comprises a reflector;

the plurality of LEDs and the plurality of collimators being arranged so as to provide a concentrated beam of light directed along an axis, such that the combined light beams are converged to a defined diameter at a defined distance from the housing;

wherein the handle extends downward from the housing so that a user may grasp the handle into the palm of a hand with the forearm extending parallel to the axis;

wherein each LED includes an angled spacer so as to direct a light beam from the LED and the corresponding collimator for convergence in a direction mostly parallel with the axis, but slightly directed toward the axis.

4. A light, comprising:

a housing;

a handle connected to the housing and configured and arranged for at least one of transporting or aiming the light;

a plurality of LEDs mounted to the housing and provided on a common circuit board; and for each LED, a collimator for collimating light emanating from the LED so that there are a plurality of collimators on the light, wherein each of the collimators comprises a reflector;

the plurality of LEDs and the plurality of collimators being arranged so as to provide a concentrated beam of light directed along an axis, such that the combined light beams are converged to a defined diameter at a defined distance from the housing;

wherein the handle extends downward from the housing so that a user may grasp the handle into the palm of a hand with the forearm extending parallel to the axis;

wherein the LEDs are mounted so that light from each of the LEDs projects perpendicular to the common circuit board, and wherein each collimator is aligned to direct a light beam from the respective LED in a direction mostly parallel with the axis, but slightly directed toward the axis.

5. A light, comprising:

a housing;

a handle connected to the housing and configured and arranged for at least one of transporting or aiming the light;

a plurality of LEDs mounted to the housing; and for each LED, a collimator for collimating light emanating from the LED so that there are a plurality of collimators on the light;

the plurality of LEDs and the plurality of collimators being arranged so as to provide a concentrated beam of light directed along an axis;

wherein the plurality of LEDs and associated collimators are arranged and configured so that light beams from the collimators are collimated such that the distance between the centers of adjacent light beams remains constant as the light beams move away from the housing;

wherein the cross section of each light beam increases slightly as the distance increases from the housing so that proper collocation of the light beams occurs at a desired distance from the housing.

* * * * *